US010344716B2

(12) United States Patent
Brygard et al.

(10) Patent No.: US 10,344,716 B2
(45) Date of Patent: Jul. 9, 2019

(54) TUNABLE INTAKE SYSTEM FOR EXHAUST GAS RECIRCULATION IN AN INTERNAL COMBUSTION ENGINE

(71) Applicant: Volvo Car Corporation, Gothenburg (SE)

(72) Inventors: Stefan Brygard, Sandared (SE); Niklas Sjoholm, Gothenburg (SE)

(73) Assignee: VOLVO CAR CORPORATION, Gothenburg (SE)

( * ) Notice: Subject to any disclaimer, the term of this patent is extended or adjusted under 35 U.S.C. 154(b) by 0 days.

(21) Appl. No.: 15/353,004

(22) Filed: Nov. 16, 2016

(65) Prior Publication Data

US 2017/0138318 A1 May 18, 2017

(30) Foreign Application Priority Data

Nov. 17, 2015 (EP) ..... 15194885

(51) Int. Cl.
*F02M 26/17* (2016.01)
*F02M 26/42* (2016.01)
(Continued)

(52) U.S. Cl.
CPC ..... *F02M 26/17* (2016.02); *F02M 26/19* (2016.02); *F02M 26/20* (2016.02); *F02M 26/21* (2016.02);
(Continued)

(58) Field of Classification Search
CPC ..... F02M 2026/005; F02M 2026/009; F02M 26/12; F02M 26/13; F02M 26/17;
(Continued)

(56) References Cited

U.S. PATENT DOCUMENTS 5,957,116 A * 9/1999 Haegele ..... F02M 35/10052 123/568.12
6,308,666 B1 * 10/2001 Drecq ..... F02B 27/06 123/58.8
(Continued)

FOREIGN PATENT DOCUMENTS

DE 19631337 A1 2/1998
EP 2881576 A1 6/2015
(Continued)

*Primary Examiner* — Sizo B Vilakazi
*Assistant Examiner* — Kevin R Steckbauer
(74) *Attorney, Agent, or Firm* — Snyder, Clark, Lesch & Chung, LLP

(57) ABSTRACT

The invention relates to a tunable intake system for exhaust gas recirculation in an internal combustion engine with a plurality of cylinders. The system comprises an exhaust gas recirculation manifold arranged to distribute recirculated exhaust gas in an intake air stream to be introduced into the combustion engine; wherein the manifold has an exhaust gas recirculation inlet and an intake air inlet as well as at least one outlet leading to the multiple cylinders of the engine. The system also comprises a first distribution pipe, which has a first pattern of flow distribution perforations for distributing the recirculated exhaust gas into the manifold. The system further includes a second distribution pipe with a second pattern of flow distribution perforations for distributing the recirculated exhaust gas into the manifold, and at least one of the first and second distribution pipes being rotatable with respect to the other.

15 Claims, 1 Drawing Sheet

(51) Int. Cl.

| | |
|---|---|
| ***F02M 26/51*** | (2016.01) |
| ***F02M 26/20*** | (2016.01) |
| ***F02M 26/21*** | (2016.01) |
| ***F02M 35/10*** | (2006.01) |
| ***F02M 26/19*** | (2016.01) |
| *F02M 26/00* | (2016.01) |
| *F02M 26/13* | (2016.01) |
| *F02M 26/54* | (2016.01) |
| *F02M 26/70* | (2016.01) |

(52) U.S. Cl.
CPC ..... *F02M 26/42* (2016.02); *F02M 26/51* (2016.02); *F02M 35/10222* (2013.01); *F02M 26/13* (2016.02); *F02M 26/54* (2016.02); *F02M 26/70* (2016.02); *F02M 35/10262* (2013.01); *F02M 2026/001* (2016.02); *F02M 2026/009* (2016.02)

(58) Field of Classification Search
CPC ..... F02M 26/19; F02M 26/20; F02M 26/21; F02M 26/65
See application file for complete search history.

(56) References Cited

U.S. PATENT DOCUMENTS

| | | | | |
|---|---|---|---|---|
| 9,650,999 | B2 * | 5/2017 | Ferlay | F02M 26/12 |
| 9,822,735 | B2 * | 11/2017 | Odillard | F02M 35/10222 |
| 9,920,721 | B2 * | 3/2018 | Lallemant | F02M 35/10222 |
| 2013/0298884 | A1 * | 11/2013 | Odillard | F02M 35/10222 123/568.17 |
| 2015/0159590 | A1 * | 6/2015 | Ferlay | F02M 26/12 123/540 |
| 2016/0160805 | A1 * | 6/2016 | Polcyn | F02M 26/70 123/568.18 |
| 2016/0215737 | A1 * | 7/2016 | Lallemant | F02M 35/10222 |

FOREIGN PATENT DOCUMENTS

| | | | | |
|---|---|---|---|---|
| FR | 2927373 | A1 | 8/2009 | |
| FR | 2928704 | A1 | 9/2009 | |
| JP | 61014462 | A * | 1/1986 | F02B 17/00 |
| JP | H0615857 | A * | 1/1986 | F02B 17/00 |
| JP | 3809696 | B2 * | 8/2006 | F02M 26/19 |
| WO | 2009141212 | A1 | 11/2009 | |

* cited by examiner

TUNABLE INTAKE SYSTEM FOR EXHAUST GAS RECIRCULATION IN AN INTERNAL COMBUSTION ENGINE

RELATED APPLICATION

This application claims priority under 35 U.S.C. § 119 based on European Patent Application No. 15194885.8, filed Nov. 17, 2015, the disclosure of which is hereby incorporated by reference herein.

TECHNICAL FIELD

The invention relates to a tunable intake system for exhaust gas recirculation (EGR) in an internal combustion engine with a plurality of cylinders. The system comprises an exhaust gas recirculation manifold arranged to distribute recirculated exhaust gas in an intake air stream to be introduced into the combustion engine.

BACKGROUND

Exhaust gas recirculation (EGR) systems are well known in the art per se and are used for controlling the generation of pollutant gases and particulate matter in internal combustion engines. EGR systems recirculate the exhaust gas into the intake air supply of the engine. The exhaust gas that is reintroduced into the engine reduces the concentration of oxygen in the intake air which reduces the maximum combustion temperature within the cylinders and slows down the chemical reaction of the combustion process, which reduces the formation of nitrous oxides.

A problem with existing EGR systems is poor or less effective mixing and distribution of the exhaust gas and the fresh intake air. This causes problems with smoke and unwanted emissions. The use of EGR-distribution rails on modern vehicles improves the EGR-distribution but current systems are inherently hard or impossible to tune for multiple operational points of the internal combustion engine. This normally means that the distribution rail is optimized for one driving point or operational point only and that the engine control unit simply inactivates EGR-function in other operational points. Hence there is a need for EGR-systems that may easily tuned for optimum EGR-performance in multiple operational points of the engine.

SUMMARY

In order to alleviate the problem mentioned above it is an object of the invention to provide a tunable intake system for exhaust gas recirculation in an internal combustion engine with a plurality of cylinders, wherein the system comprises an exhaust gas recirculation manifold arranged to distribute recirculated exhaust gas in an intake air stream to be introduced into the combustion engine, where the manifold has an exhaust gas recirculation inlet and an intake air inlet as well as at least one outlet leading to the multiple cylinders of the engine. The manifold also has a first distribution pipe connected to the exhaust gas recirculation inlet, which first distribution pipe has a first pattern of flow distribution perforations for distributing the recirculated exhaust gas into the manifold. The invention is especially characterized in:

a second distribution pipe with a second pattern of flow distribution perforations for distributing the recirculated exhaust gas into the manifold is fitted outside of said first distribution pipe whereby an interstitial gap is formed therebetween; and at least one of said first and second distribution pipes being rotatable with respect to the other in order to selectively tune the distribution of recirculated exhaust gas for multiple operational points of the engine.

I an advantageous embodiment of the invention, the first and second distribution pipes are concentrically arranged and independently rotatable with respect to each other.

In an advanced embodiment of the invention, an engine control unit (ECU) is arranged to adapt the relative positions of the first pattern and the second pattern of flow distribution perforations for an optimal distribution of the recirculated exhaust gas depending on a given point of operation of the engine. Preferably, the engine control unit, or ECUI, is arranged to adapt the relative positions of the first pattern and the second pattern of flow distribution perforations via a first rotating means for rotating the first distribution pipe and a second rotating means for rotating the second distribution pipe.

In alternative embodiments of the invention, the perforations are shaped as ovals or as elongated slots.

The invention also covers an automotive vehicle having a tunable intake system as described above.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

DETAILED DESCRIPTION OF EXAMPLE EMBODIMENTS OF THE INVENTION

Figure 1:
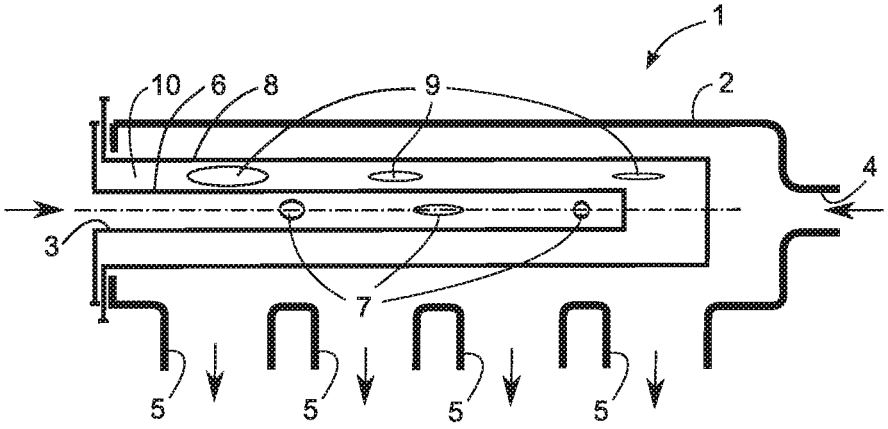
FIG. 1 shows a simplified schematic overview of a tunable intake system for exhaust gas recirculation (EGR) according to a first exemplifying embodiment of the present invention.

The invention will now be described with reference to embodiments of the invention and with reference to the appended drawings. With initial reference to FIG. 1, this figure shows a schematic overview of a first exemplifying embodiment of a tunable intake system 1 for exhaust gas recirculation (EGR) in an internal combustion engine with a plurality of cylinders. The engine and its cylinders are not shown in the drawings as the invention is focussed on the intake system 1 itself.

The intake system 1 includes an exhaust gas recirculation manifold 2 which is arranged to distribute recirculated exhaust gas in an intake air stream to be introduced into the combustion engine. The manifold 2 has an exhaust gas recirculation inlet 3 and an intake air inlet 4 as well as at least one outlet 5 leading to the multiple cylinders of the engine (not shown). A first distribution pipe 6 is connected to the exhaust gas recirculation inlet 3 and is provided with first pattern of flow distribution perforations 7 for distributing the recirculated exhaust gas into the manifold 2. A second distribution pipe 8 with a second pattern of flow distribution perforations 9 for distributing the recirculated exhaust gas into the manifold 2 is fitted outside of said first distribution pipe 6 whereby an interstitial gap 10 is formed therebetween. According to the invention at least one of said first and second distribution pipes 6, 8 are rotatable with respect to the other in order to selectively tune the distribution of recirculated exhaust gas for multiple operational points of the engine. By the term operational points is meant specific points of engine speed and associated torque as known per se.

The first and second distribution pipes 6, 8 are preferably independently rotatable with respect to each other. Alternatively, only one of the distribution pipes 6, 8 is rotatable whilst the other is fixed. In a well-functioning embodiment of the invention one or both of the distribution pipes 6, 8 can be tuned and set at a desired degree of rotation during a planned service of the engine.

Figure 2:
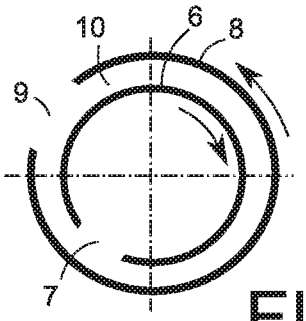
FIG. 2 shows a schematic cross-sectional view of the concentrically arranged first and second distribution pipes which may be tuned by rotation with respect to each other.

As shown in the cross-sectional view of FIG. 2, the first and second distribution pipes 6, 8 are concentrically arranged with respect to each other, forming the interstitial gap 10 in between.

Figure 3:
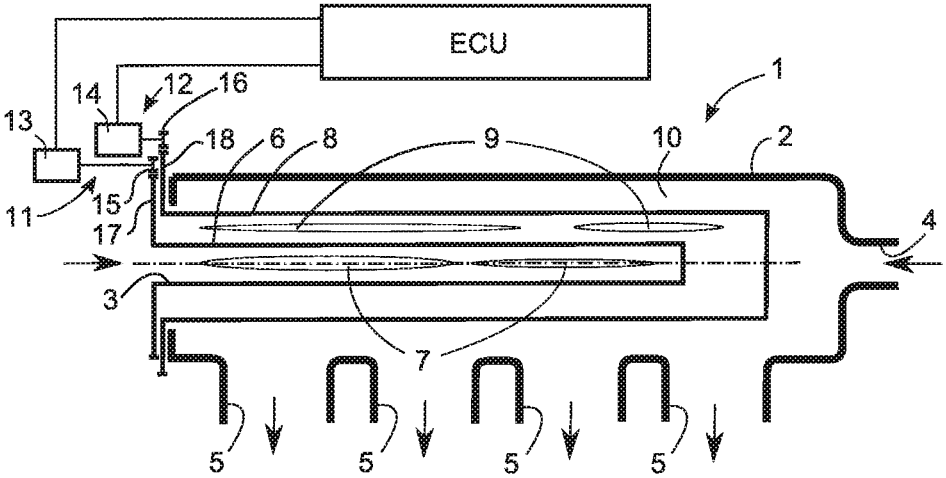
FIG. 3 finally shows an alternative embodiment of the invention, in which an engine control unit (ECU) is arranged to adapt the relative positions of the first pattern and the second pattern of flow distribution perforations.

In an alternative embodiment of the invention shown in FIG. 3, an engine control unit (ECU) is arranged to adapt the relative positions of the first pattern and the second pattern of flow distribution perforations 7, 9 for an optimal distribution of the recirculated exhaust gas depending on a given point of operation of the engine. The engine control unit (ECU) is arranged to adapt the relative positions of the first pattern and the second pattern of flow distribution perforations 7, 9 via a first rotating means 11 for rotating the first distribution pipe 6 and a second rotating means 12 for rotating the second distribution pipe 8. The first and second rotating means 11, 12 shown in the exemplifying embodiment includes electric servo motors 13 and 14 respectively. The servo motors 13, 14 are connected to pinion gears 15 and 16 that in turn rotate geared tuning discs 17 and 18 fixedly connected to the rotatable distribution pipes 6, 8 as schematically shown in FIG. 3.

In the exemplifying first embodiment shown in FIG. 1, the perforations 7, 9 in the distribution pipes 6, 8 are shaped as ovals, but they may alternatively be shaped as elongated slots as shown in the second embodiment in FIG. 3.

The invention also refers to an automotive vehicle (not shown) that has a tunable intake system 1 as described above.

It is to be understood that the present invention is not limited to the embodiments described above and illustrated in the drawings and a skilled person will recognize that many changes and modifications may be made within the scope of the appended claims.

The invention claimed is:

1. A tunable intake system for exhaust gas recirculation in an internal combustion engine with a plurality of cylinders, the system comprising:

an exhaust gas recirculation manifold arranged to distribute recirculated exhaust gas in an intake air stream to be introduced into the internal combustion engine, the exhaust gas recirculation manifold having an exhaust gas recirculation inlet, an intake air inlet and at least one outlet leading to the plurality of cylinders;

a first distribution pipe connected to the exhaust gas recirculation inlet, said first distribution pipe having a first pattern of flow distribution perforations for distributing the recirculated exhaust gas into the exhaust gas recirculation manifold; and a second distribution pipe with a second pattern of flow distribution perforations for distributing the recirculated exhaust gas into the exhaust gas recirculation manifold, wherein the second distribution pipe is fitted outside of said first distribution pipe such that an interstitial gap is formed between the first distribution pipe and the second distribution pipe, and wherein the first distribution pipe and the second distribution pipe are separated by the interstitial gap such that the first distribution pipe is not in contact with the second distribution pipe, and at least one of said first or second distribution pipes being rotatable to selectively tune the distribution of recirculated exhaust gas for multiple operational points of the internal combustion engine, wherein the interstitial gap is configured to allow for a gas flow from the first pattern of flow distribution perforations in the first distribution pipe to the second pattern of flow distribution perforations in the second distribution pipe independent of relative rotational orientations of the first distribution pipe or the second distribution pipe.

2. A tunable intake system according to claim 1, wherein the first and second distribution pipes are independently rotatable with respect to each other.

3. A tunable intake system according to claim 1, wherein the first and second distribution pipes are concentrically arranged with respect to each other.

4. A tunable intake system according to claim 1, wherein an engine control unit (ECU) is arranged to adapt relative positions of the first pattern and the second pattern of flow distribution perforations for an optimal distribution of the recirculated exhaust gas depending on a given point of operation of the internal combustion engine.

5. A tunable intake system according to claim 4, wherein the ECU is arranged to adapt the relative positions of the first pattern and the second pattern of flow distribution perforations via a first rotating means for rotating the first distribution pipe and a second rotating means for rotating the second distribution pipe.

6. A tunable intake system according to claim 1, wherein the flow distribution perforations are shaped as ovals.

7. A tunable intake system according to claim 1, wherein the flow distribution perforations are shaped as elongated slots.

8. An automotive vehicle having a tunable intake system according to claim 1.

9. A system comprising:

an exhaust gas recirculation manifold including an exhaust gas recirculation inlet;

a first distribution pipe connected to the exhaust gas recirculation inlet, wherein the first distribution pipe includes a first pattern of flow distribution perforations for distributing recirculated exhaust gas into the exhaust gas recirculation manifold; and a second distribution pipe including a second pattern of flow distribution perforations for distributing the recirculated exhaust gas into the exhaust gas recirculation manifold, wherein the second distribution pipe is fitted outside of the first distribution pipe such that a gap is formed between the second distribution pipe and the first distribution pipe, wherein the gap separates the first distribution pipe and the second distribution pipe such that the first distribution type is not in contact with the second distribution pipe, and wherein the first distribution pipe is rotatable with respect to the second distribution pipe or the second distribution pipe is rotatable with respect to the first distribution pipe, wherein the gap is configured to allow for a gas flow from the first pattern of flow distribution perforations in the first distribution pipe to the second pattern of flow distribution perforations in the second distribution pipe independent of relative rotational orientations of the first distribution pipe or the second distribution pipe.

10. The system of claim 9, wherein the first distribution pipe and the second distribution pipe are independently rotatable with respect to each other.

11. The system of claim 9, wherein the first distribution pipe and the second distribution pipe are concentrically arranged with respect to each other.

12. The system of claim 9, further comprising an engine and an engine control unit (ECU) configured to control positions of the first pattern of flow distribution perforations and the second pattern of flow distribution perforations for the recirculated exhaust gas to the engine based on operation of the engine.

13. The system of claim 12, wherein the ECU is configured to control the positions of the first pattern of flow distribution perforations and the second pattern of flow distribution perforations via a first rotating means for rotating the first distribution pipe and a second rotating means for rotating the second distribution pipe.

14. The system of claim 9, wherein the flow distribution perforations are shaped as ovals.

15. The system of claim 9, wherein the flow distribution perforations are shaped as elongated slots.

* * * * *